US005144752A

United States Patent [19]

Boeke et al.

[11] Patent Number: 5,144,752

[45] Date of Patent: Sep. 8, 1992

[54] SELF CENTERING SIGHT MOUNT

[76] Inventors: Gregg M. Boeke, 1321 Centennial Dr., No. 301, Farmington, Minn. 55024; Mark Lee, 9901 France Ct., Lakeville, Minn. 55044

[21] Appl. No.: 743,988

[22] Filed: Aug. 12, 1991

[51] Int. Cl.[5] ..... F41G 1/38

[52] U.S. Cl. ..... 33/247; 33/250; 42/101

[58] Field of Search ..... 33/247, 250, 248, 249, 33/252, 245; 42/101, 100

[56] References Cited

U.S. PATENT DOCUMENTS

| | | | |
|---|---|---|---|
| 2,445,595 | 7/1948 | Bengert | 42/101 |
| 2,539,008 | 1/1951 | Brookhyser | 33/250 |
| 2,580,246 | 12/1951 | Schall | 33/250 |
| 2,585,985 | 2/1952 | Anderson | 33/250 |
| 2,767,473 | 10/1956 | Craven . | |
| 2,836,895 | 6/1958 | Dillon | 33/245 |
| 2,857,675 | 10/1958 | Kesselring | 33/245 |
| 2,924,881 | 2/1960 | Gee | 42/101 |
| 2,931,101 | 4/1960 | Martin | 42/101 |
| 3,153,856 | 10/1964 | Felix | 42/100 |
| 3,295,811 | 1/1967 | Giwosky | 33/245 |
| 3,374,544 | 3/1968 | Pitchford | 33/247 |
| 3,579,840 | 5/1971 | Heinzel | 42/101 |
| 4,044,486 | 8/1977 | Van Holten | 42/101 |
| 4,085,511 | 4/1978 | Kovac | 42/101 |
| 4,092,793 | 6/1978 | Ricks | 42/101 |
| 4,121,363 | 10/1978 | York | 33/250 |
| 4,703,576 | 11/1987 | Burris | 33/247 |

*Primary Examiner*—Allan N. Shoap
*Assistant Examiner*—William C. Dowling
*Attorney, Agent, or Firm*—Jacobson & Johnson

[57] ABSTRACT

A detachable mounting post to permit a user to remove or reattach a telescopic sight without having to realign the sight with the rifle. The mounting post includes an axial displaceable stirrup that can be moved along the axis of a mounting post by the coaction of a threaded anvil having cam surfaces that engage mating cam surfaces on the stirrup as a user rotates a longitudinally fixedly mounted screw to pull or push the anvil in a direction perpendicular to the axis of the mounting post which causes balls located in the mounting post to center the mounting post both vertically and concentrically within a mounting socket located in a mounting block on a rifle.

13 Claims, 2 Drawing Sheets

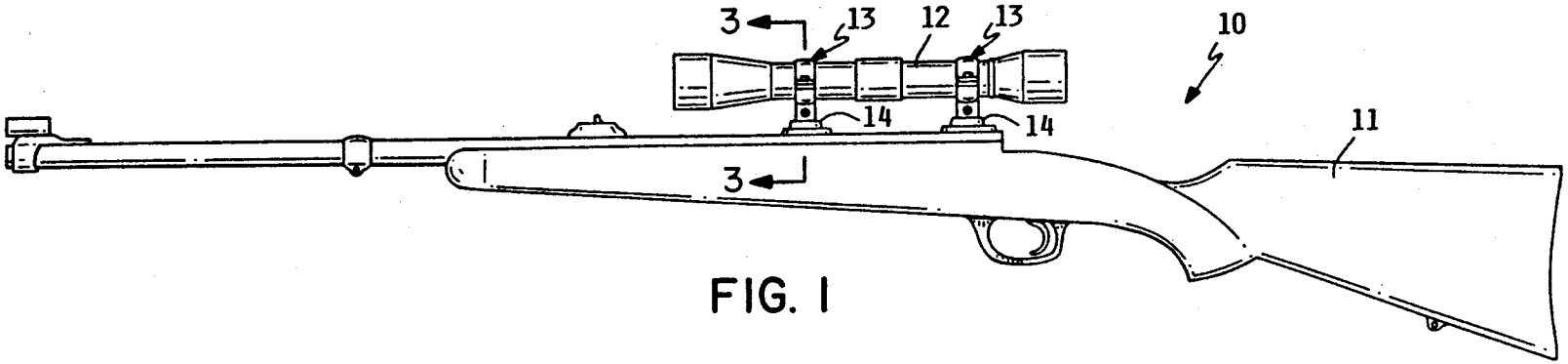
FIG. 1
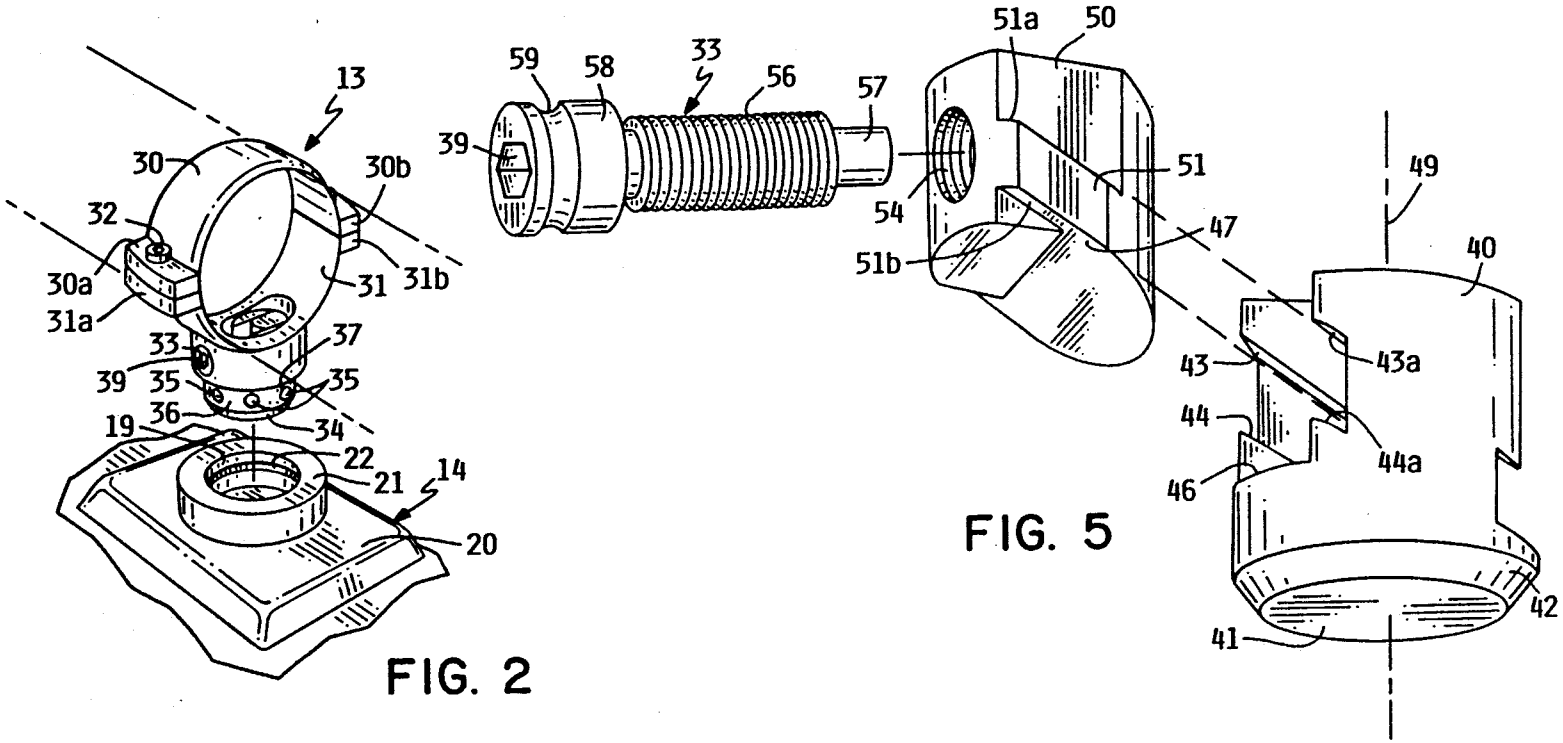
FIG. 5
FIG. 2

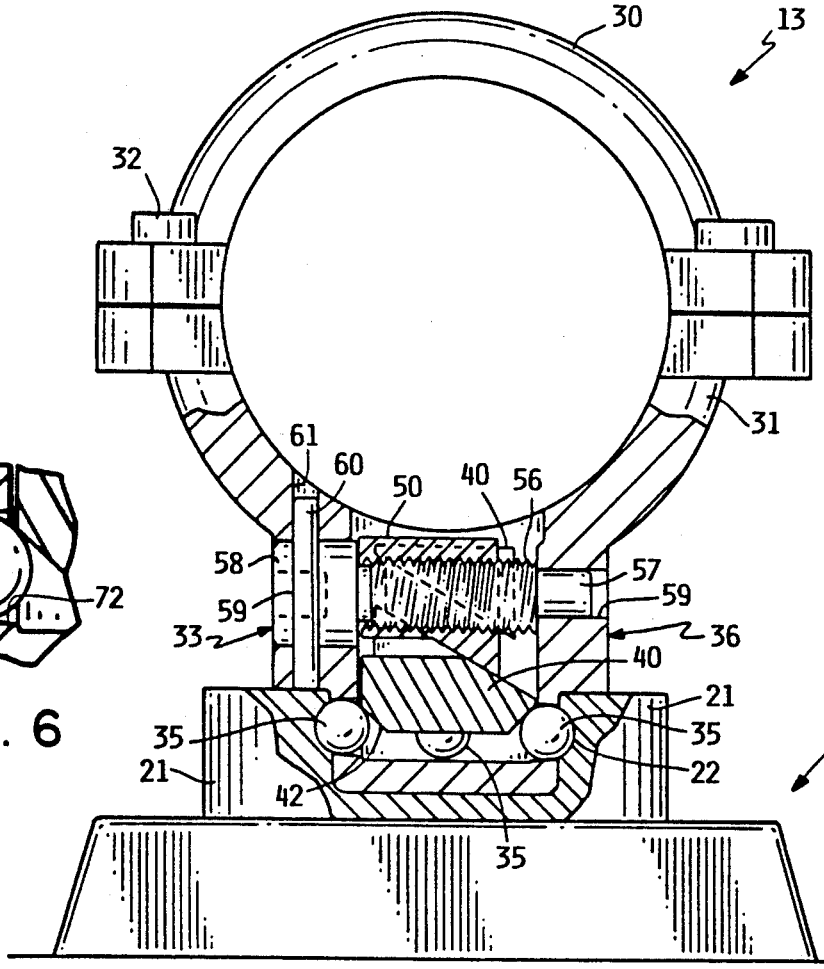
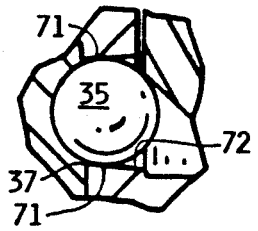
FIG. 6
FIG. 3
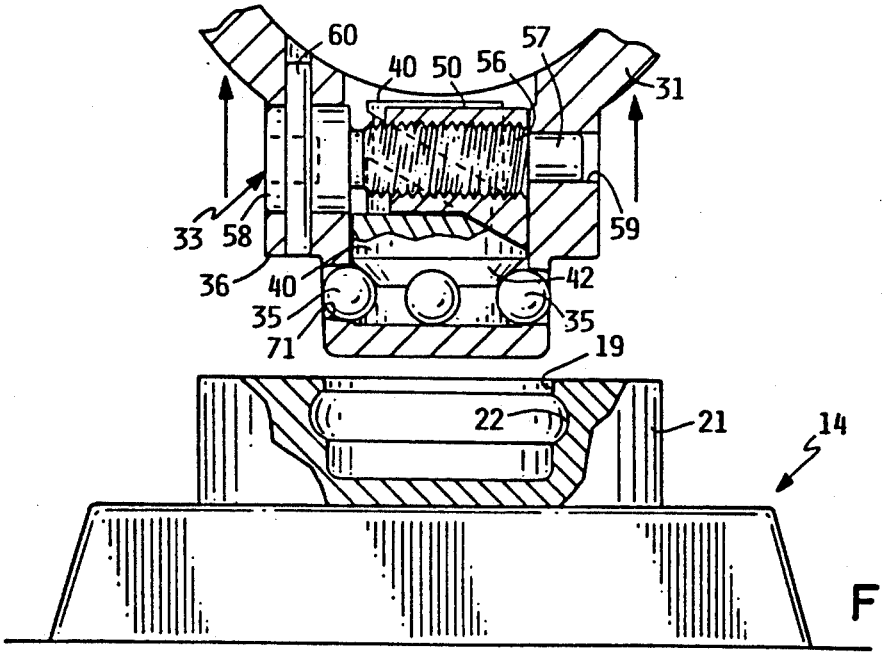
FIG. 4

SELF CENTERING SIGHT MOUNT

FIELD OF THE INVENTION

This invention relates generally to detachable telescope sight mounts and more specifically, to detachable telescope sight mounts that permit a user to accurately reposition the telescopic sight once the sight has been removed without having to readjust the sights.

BACKGROUND OF THE INVENTION

The concept of detachable telescopic sights for guns is well known in the art. Typically, a first mounting member on the sight engages a second mounting member on a mounting block located on the gun barrel. The mounting members used include dovetails, latches and even magnets. One of the problems with such mounting members is that the the mounting members may become dirty or worn and cause misalignment. The present invention provides an improved mount that permits the sight to be accurately and quickly repositioned even though the mounting members may become worn or dirty.

DESCRIPTION OF THE PRIOR ART

U.S. Pat. No. 2,445,595 shows a mounting member for a sight that has a round post that is forced against one side of the cavity by a threaded pin.

U.S. Pat. No. 2,539,008 shows a hinge pin arrangement on the front of the scope and a spring pressed ball detent to hold the rear of the scope in position.

U.S. Pat. No. 2,580,246 shows a detachable mounted sight using base blocks with a forward extending extension to hook into the mounting block.

U.S. Pat. No. 2,585,985 shows a tapered front stud that fits into a tapered recess with a rear mount and spring biased ball detents.

U.S. Pat. No. 2,767,473 shows latch finger that engages a latch recess in the mounting member on the gun.

U.S. Pat. No. 2,836,895 shows cylindrical plugs that engage cylindrical recesses and a front latch tooth for engaging the mounting member on the gun.

U.S. Pat. No. 2,857,675 shows a detachable scope with a flat ended screw that is used as a reference in realigning the scope each time the scope is remounted.

U.S. Pat. No. 2,924,881 shows a magnetically mounted scope that uses cylindrical pins and recess for aligning the scope with the mounting plate on the rifle.

U.S. Pat. No. 2,931,101 shows a pin mounted scope with magnets to hold the scope on the rifle mounting members.

U.S. Pat. No. 3,153,856 shows a telescopic sight that uses dovetails to realign the scope with the mounting member.

U.S. Pat. No. 3,259,811 shows a sight with longitudinal grooves that one draws the sight into position with a diagonally placed bolt.

U.S. Pat. No. 3,579,840 shows a rifle mount with a pair of divergent shoulders for engaging mating members on the telescopic sights.

U.S. Pat. No. 4,044,486 uses two wedge surfaces that engage the clamping wedges of a sight.

U.S. Pat. No. 4,085,511 shows a sight with flats to engage the telescopic sights.

U.S. Pat. No. 4,092,793 shows a clip on sight with a V-groove and pin arrangement for coupling the sight to the gun.

U.S. Pat. No. 4,121,363 shows a cam surface arrangement to engage the sights with the mounting members on the gun.

BRIEF DESCRIPTION OF THE DRAWINGS

FIG. 1 shows a side view of a rifle having our detachable mounting mounting posts;

FIG. 2 shows and exploded view of the mounting post and the mounting block;

FIG. 3 shows a partial sectional view showing the mounting post engaging the mounting ring on the mounting block; FIG. 4 shows the mounting post disengaged from the mounting block with the retaining balls located in a retracted position;

FIG. 5 shows and exploded view of the mechanisms for forcing the balls radially outward; and;

FIG. 6 shows a partial exploded view of the retaining member for holding the retaining balls in the mounting post.

SUMMARY OF THE INVENTION

Briefly, the present invention comprises a self centering mount for a rifle that includes a mounting post containing an axial displaceable stirrup that can be moved along the axis of a mounting post by the coaction of a threaded anvil having cam surfaces that engage mating cam surfaces on the stirrup. As a user rotates a longitudinally fixedly mounted screw it pulls the anvil in a first direction perpendicular to the axis of the mounting post causing a plurality of circumferentially spaced balls to move radially outward and center the mounting post within a mounting socket located on the rifle. The balls hold the mounting post in the center of the mounting socket until the longitudinally mounted screw is rotated in the opposite direction forcing the anvil in a second direction opposite to the first direction but perpendicular to the axis of the mounting post. A cam surface on the anvil lifts the stirrup upward allowing the balls to retract centrally away from the mounting socket to allow the mounting post to be removed from the mounting socket.

DESCRIPTION OF THE PREFERRED EMBODIMENT

Referring to FIG. 1 reference numeral 10 generally identifies a rifle having a stock 11 and a telescopic sighting device or scope 12 mounted on top of the rifle by split ring scope holders 13 and mounting blocks 14. Split ring scope holders 13 frictionally hold scope 12 in position.

FIG. 2 shows an exploded view of a mounting post 36 having a split ring scope holder 13 attached thereto. Split ring scope holder 13 includes a first semicircular member 30 and a second semicircular member 31 that are held together by a first cap screw 32 that engages flange **30*a* on member 30 and flange 31*a* on member 31 and a second cap screw (not shown) that engages flange 30*b* on member 30 and flange 31*b* on member 31. A first split ring scope holder 13 is located on the front of the scope and a second split ring scope holder 13 is located on the rear portion of the scope to provide two position attachment of the scope to the mounting blocks 14 on the top surface of rifle 10**.

Mounting post 36 includes a plurality of balls 35 that are displaceable radially outward to engage an annular socket 22 located in mounting ring 21. The mounting ring 21 fastens directly to mounting block 14 which is held on the rifle through fastening means such as screws or the like. Mounting ring 21 includes a cylindrical surface 19 having an annular mounting socket 22 for engaging balls 35 from mounting post 36. Located on the side of mounting post 36 is a cap screw 33 having a hex opening 39 to permit an operator to rotate cap screw 33 with an Allen wrench.

FIG. 5 shows a partial exploded view of the drive mechanism located in the mounting post for radially displacing balls 35 in mounting post 33. The drive mechanism includes a cylindrical shaped stirrup 40 that moves upward and downward along a central axis 49 in a cylindrical chamber in the mounting post 36. The lower exterior of stirrup 40 includes a bottom surface 41 and a beveled driving face 42 which is typically located at an angle of about 45 degrees to axis 49. The interior of stirrup 40 includes a first upper cam surface 43 and a first lower cam surface 44 located on one side of the stirrup 40 and a second upper cam surface **43*a* and a second lower cam surface 44*a* located on the opposite side of stirrup 40. A third angled surface 46 extends from one side of stirrup 40 to the opposite side of stirrup 40**.

Reference numeral 50 indentifies anvil 50 that drives stirrup 40 upward and downward through the coaction of cap screw 33 and mounting post 36. Located on one side of anvil 50 is a a first angled cam member 51 having an upper cam surface **51*a* for engaging surface 43*a* of stirrup 40 and a lower cam surface 51*b* for engaging cam surface 44*a* of stirrup 40. Similarly, located on the opposite side of anvil 50 is a second angled cam member (not shown) having an upper cam surface for engaging surface 43 of stirrup 40 and a lower cam surface for engaging cam surface 44 of stirrup 40. Both cam members are located a parallel relationship to one another to permit the sliding of anvil 50 on the surfaces of stirrup 40. Located on the interior of anvil 50 is a threaded recess 54 for engaging a drive or cap screw 33**.

The cap screw 33 includes a threaded portion 56 with a cylindrical bearing surface 57 for engaging a cylindrical bearing recess 59 (FIG. 3) on one side of mounting post 36. Cap screw 33 includes a head 58 having an annular recess 59 to prevent lengthwise displacement of cap screw 33 as the screw is rotated. FIG. 3 shows a pin 60 extending into a cylindrical opening 61 in mounting post 36. The cylindrical pin 60 engages annular recess 59 to permit rotation of cap screw 33 but prevent lengthwise displacement of cap screw 33. FIG. 3 and FIG. 4 illustrate the coaction of cap screw 33, anvil 50, stirrup 40, mounting post 36, and retractable balls 35.

FIG. 3 shows retractable balls 35 in the extended position locking mounting post 36 in mounting ring 21 and FIG. 4 shows retractable balls 35 in the retracted position permitting removal of mounting post 36 from mounting ring 21.

To illustrate the operation of the anvil 50 and stirrup 40 reference should be made to FIG. 4 which shows anvil 50 displaced leftward and stirrup 40 in the upward position. In order to extend balls 35 outward the user rotates cap screw 59 to pull anvil 50 toward the left side of mounting post 36. FIG. 3 shows anvil 50 pulled toward the left side of mounting post 36. As anvil 50 is moved toward the left side of mounting post 33 it forces stirrup 40 downward until beveled driving surface 42 forces balls 35 radially outward where balls 35 lockingly engage annular socket 22.

In order to prevent balls 35 from falling out of openings 37 in mounting post 36 the inside minimum diameter of the opening for is less than the major diameter of sphere 35. FIG. 6 shows the minimum diameter area designated by reference numeral 71. Consequently, balls 35 remain in the mounting post 33.

In operation of the invention the spherical balls 35 form contact with only a portion of the interior of the annular socket 22. Because the balls only form contact with a portion of the annular socket 22 the self centering of the mounting post with the socket becomes very precise because with as few as six balls the balls center themselves and consequently mounting post 33 in mounting ring 21. The use of two mounting posts, one on the front of the scope and the other on the rear of the scope provides the axial two point alignment to ensure that the scope remains in the proper lateral orientation. The balls 35 not only provide for lateral self centering action they also provide for repeating vertical alignment since the balls center themselves vertically as well as concentrically with annular socket 22.

FIG. 5 shows a cap screw 33 for driving anvil 50. Although a cap screw is shown with an Allen head 59 the Allen head 59 could be replaced by a lever thus allowing the user to mount or dismount mounting post 36 without the use of tools.

We claim:

1. A detachable sight mount for vertically and concentrically centering a telescopic sight on a weapon comprising:

a mounting block for attaching to a weapon;

a mounting ring located on said mounting block for receiving a removable mounting post, said mounting ring including an annular socket;

a mounting post for engaging said mounting ring, said mounting post having a central bore with a central axis, said mounting post having a plurality of circumferentially spaced openings;

a stirrup for movement along said central axis;

an anvil located in said stirrup, said anvil having a threaded opening;

a threaded member having a lengthwise direction, said threaded member for rotatable mounting in said mounting post;

means for preventing lengthwise displacement of said threaded member, said threaded member having threads to move said anvil perpendicular to the central axis of said mounting post when said threaded member is restrained from movement along its length by said means for preventing lengthwise displacement of said threaded member; and a plurality of balls located in said mounting post, each of said balls located proximate one of said openings so that when said stirrup is moved in a first axial direction it forces said balls radially outward from said mounting post until said balls engage said annular socket to thereby vertically and concentrically center said mounting post in said mounting ring to permit the remounting of a telescopic sight without having to realign the scope.

2. The detachable sight mount of claim 1 including a beveled driving face on said stirrup for forcing said balls radially outward with said bevel located at about a 45 degree angle to said axis.

3. The detachable sight mount of claim 1 including a first angled cam surface on said anvil and a second angled follower surface on said stirrup so that when said anvil is moved perpendicular to said axis said stirrup is forced to move within the bore of said mounting post in a direction along said axis.

4. The detachable sight mount of claim 1 including a second sight mounting post and a second mounting block so that when said first sight mounting post is in engagement with said first mounting block it permits a user to align said first mounting post with said first mounting block and said second mounting post with said second mounting block.

5. The detachable sight mount of claim 1 including a cylindrical recess on said threaded member and a pin for engaging said threaded recess to restrain said threaded member from movement perpendicular to the axis of said mounting post.

6. The detachable sight mount of claim 1 wherein said anvil has cam surfaces that are located at approximately a 45 degree angle to said axis of said mounting post.

7. The detachable sight mount of claim 1 wherein a clearance between said mounting post and said mounting ring is less than 0.005 of an inch.

8. The detachable sight mount of claim 1 wherein said opening in said mounting post has a minor dimension that is less than the major diameter of a ball located therein to prevent a ball located in said opening from falling out of the opening in said mounting post when said mounting post is removed from said annular socket in said mounting ring.

9. The detachable sight mount of claim 2 including a first angled cam surface on said anvil and a second angled follower surface on said stirrup so that when said anvil is moved perpendicular to said axis said stirrup is forced to move within the bore of said mounting post in a direction along said axis.

10. The detachable sight mount of claim 9 including a second sight mounting post and a second mounting block so that when said first sight mounting post is in engagement with said first mounting block a user can align and fasten said first mounting post with said first mounting block and fasten said second mounting post to said second mounting block.

11. The detachable sight mount of claim 10 including a cylindrical recess on said threaded member and a pin for engaging said threaded recess to restrain said threaded member from movement lengthwise of said threaded member.

12. The detachable sight mount of claim 11 wherein said mounting post includes an opening in said mounting post having a minor dimension that is less than the major diameter of a ball located therein to prevent said ball from falling out of the opening in said mounting post when said mounting post is removed from said annular socket in said mounting ring.

13. A detachable sight mount for vertically and concentrically centering a telescopic sight on a weapon comprising:

a mounting block for attaching to a weapon;

a mounting ring located on said mounting block for receiving a removable mounting post, said mounting ring including a recess;

a mounting post for engaging said mounting ring, said mounting post having a central bore with a central axis, said mounting post having a plurality of circumferentially spaced openings;

a stirrup for movement along said axis; and a plurality of balls located in said mounting post, one of said balls located proximate one of said plurality of openings so that when said stirrup is moved in a first axial direction along said axis it forces said balls radially outward from said mounting post until said balls engage said recess to thereby vertically and concentrically center said mounting post in said mounting ring to permit the remounting of a telescopic sight without having to realign the scope.

* * * * *